US005781211A

United States Patent [19]

Bobry

[11] Patent Number: 5,781,211

[45] Date of Patent: Jul. 14, 1998

[54] INK JET RECORDING HEAD APPARATUS

[76] Inventor: Howard H. Bobry, 18416 Olympic View Dr., Edmonds, Wash. 98020

[21] Appl. No.: 685,248

[22] Filed: Jul. 23, 1996

[51] Int. Cl.[6] ..... B41J 2/05

[52] U.S. Cl. ..... 347/58; 347/12; 347/62

[58] Field of Search ..... 347/62, 61, 58, 347/57, 55, 54, 68, 14, 12

[56] References Cited

U.S. PATENT DOCUMENTS

| | | | |
|---|---|---|---|
| 3,179,042 | 4/1965 | Naiman | 347/61 X |
| 4,394,670 | 7/1983 | Sugitani et al. | 347/65 |
| 4,412,224 | 10/1983 | Sugitani | 347/65 |
| 4,429,321 | 1/1984 | Matsumoto | 347/59 |
| 4,458,256 | 7/1984 | Shirato et al. | 347/58 |
| 4,463,359 | 7/1984 | Ayata et al. | 347/56 |
| 4,479,135 | 10/1984 | Kohashi | 347/55 |
| 4,588,998 | 5/1986 | Yamamuro | 347/68 |
| 4,695,853 | 9/1987 | Hackleman | 347/62 |
| 4,719,477 | 1/1988 | Hess | 347/59 |
| 4,994,826 | 2/1991 | Tellier | 347/65 |
| 5,057,855 | 10/1991 | Damouth | 347/57 |
| 5,063,655 | 11/1991 | Lamey et al. | 347/59 X |
| 5,075,250 | 12/1991 | Hawkins et al. | 437/52 |
| 5,081,474 | 1/1992 | Shibata et al. | 347/59 |
| 5,103,246 | 4/1992 | Dunn | 347/58 |
| 5,117,482 | 5/1992 | Hauber | 338/225 D X |
| 5,122,814 | 6/1992 | Endo et al. | 347/57 X |
| 5,126,768 | 6/1992 | Nozawa et al. | 347/65 |
| 5,134,425 | 7/1992 | Yeung | 347/57 X |
| 5,175,565 | 12/1992 | Ishinaga et al. | 347/67 |
| 5,223,853 | 6/1993 | Wysocki | 347/14 |
| 5,325,118 | 6/1994 | Zybin et al. | 347/47 |
| 5,343,227 | 8/1994 | Hirosawa et al. | 349/42 |
| 5,420,627 | 5/1995 | Keefe et al. | 347/87 |
| 5,477,243 | 12/1995 | Tamura | 347/12 |
| 5,479,197 | 12/1995 | Fujikawa et al. | 347/63 |
| 5,482,660 | 1/1996 | Yamamoto et al. | 264/474 |
| 5,504,505 | 4/1996 | Tamura | 347/57 X |
| 5,508,724 | 4/1996 | Boyd et al. | 347/58 |

*Primary Examiner*—Joseph W. Hartary
*Attorney, Agent, or Firm*—Rankin, Hill, Porter & Clark LLP

[57] ABSTRACT

An ink jet recording head apparatus of simplified construction comprising ink flow channels defined by electrical conductors; the conductors connected to a reduced number of drive sources by a reduced number of electrodes; and an ink supply comprised of an absorbent pad.

17 Claims, 10 Drawing Sheets

INK JET RECORDING HEAD APPARATUS

BACKGROUND OF THE INVENTION

The invention relates to an ink jet recording head. More particularly, the invention relates to a drop-on-demand, or impulse, ink jet recording head of simplified construction and drive requirements.

Impulse ink jet recording heads project ink drops to a recording medium in response to brief pulses of electrical energy applied to one or more thermal or piezoelectric pressure generating elements. These devices are well known and are commonly used for printing information on a medium, such as in computer printers to record text and graphics on paper. Ink jet recording heads known heretofore are generally constructed of two or more precision components, which must be assembled with great care to achieve proper alignment. Additionally, such heads require a large number of driving sources and electrodes to provide connection thereto. Further, ink drop trajectories are not well controlled, so the distance between the recording head and the medium must be minimized. It is desirable, for the sake of reduced mechanical complexity and cost, to produce a recording head having the ability to print a wide swath, even a fall line at a time, and to allow an increased distance between the recording head and the medium, with improved ink drop trajectory control. The aforesaid factors, however, conspire to limit the practical size, and hence the print swath, of ink jet recording heads built according to the prior art.

The objectives exist, therefore, for an ink jet recording head apparatus of simplified construction, and simplified methods of construction; and requiring a reduced number of driving sources and electrodes, and simplified driving methods, thereby reducing manufacturing costs and enabling the construction of wide swath recording heads. It is a further objective to provide improved control of ink drop trajectories, enabling an increased recording head to medium distance.

SUMMARY OF THE INVENTION

To the accomplishment of the foregoing objectives, the present invention contemplates an ink jet recording head of simplified construction, comprising a substrate; a tapped pressure generating element, the taps dividing said element into a number, N, of portions; a plurality, numbering N+1, of conductors, connecting said taps and comprising the side walls of a number, N, of ink flow channels, each of which terminates in a nozzle; electrodes interconnecting said conductors in an interdigitated pattern such that only $2\times N^{1/2}$ driving sources and electrode connections are required. Another aspect of the present invention is the ability to control the distance between the pressure generating element segments and the nozzles, thus affording superior control over ink drop trajectories. A further aspect is control of exothermic pressure generating element temperature, resulting in enhanced drop trajectory control.

These and other aspects and advantages of the present invention will be readily understood and appreciated by those skilled in the art from the following detailed description of the preferred embodiments with the best mode contemplated for practicing the invention in view of the accompanying drawings.

DETAILED DESCRIPTION OF THE INVENTION

Figure 1:
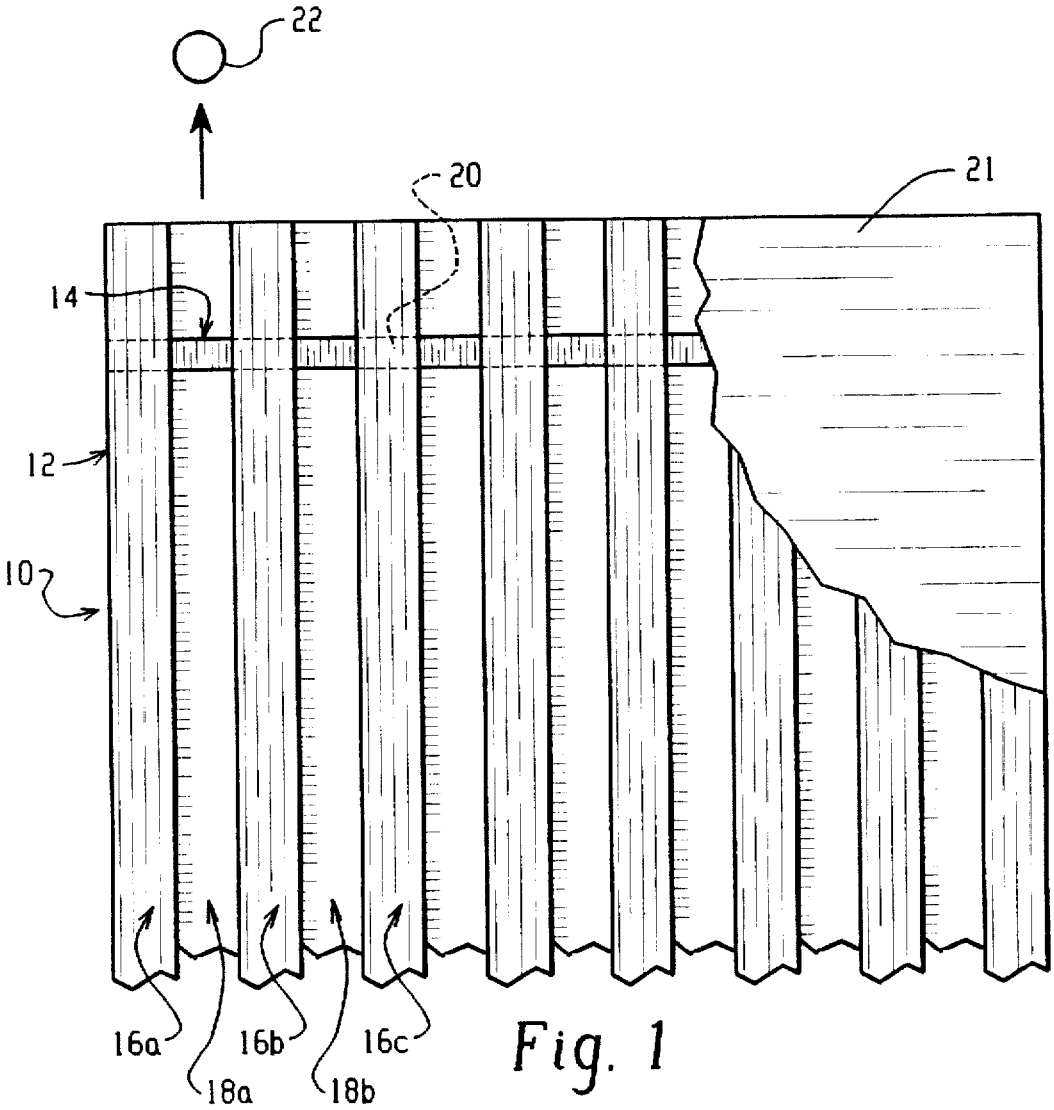
FIG. 1 is a fragmentary plan view illustrating a portion of an ink jet recording head according to the with parts broken away for the purpose of illustration.
Figure 2:
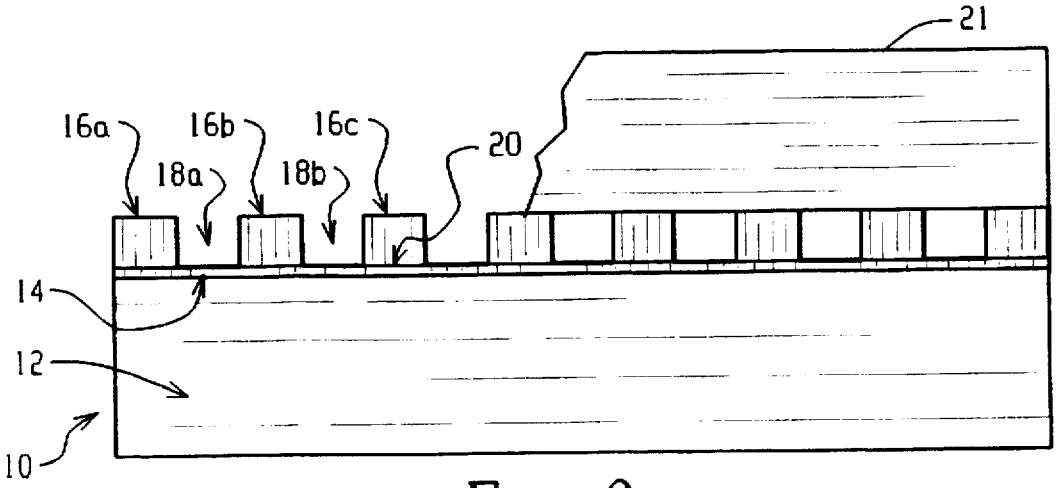
FIG. 2 an end elevation of the device of FIG. 1 with parts broken away for the purpose of illustration.

With reference to FIGS. 1 & 2, an embodiment of one aspect of the invention is illustrated in simplified schematic form for purposes of describing the basic concepts of the invention. In this basic configuration, an ink jet recording head 10 is illustrated. A significant feature of this device is that it is formed by conventional and well known etching and plating techniques, on a single substrate, with no assembly of separate precision components required.

Figure 11:
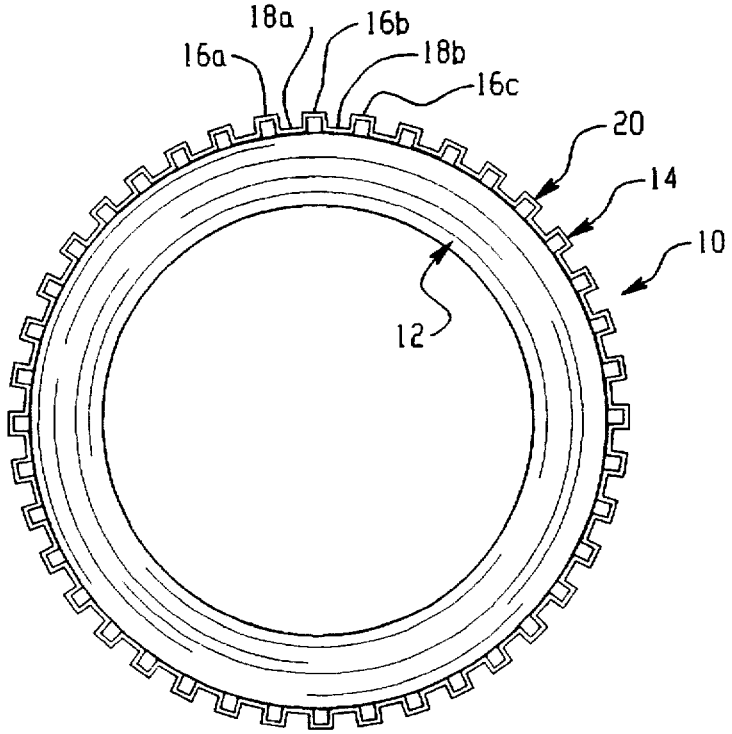
FIG. 11 is an end elevation illustrating an alternate form of the invention.
Figure 12:
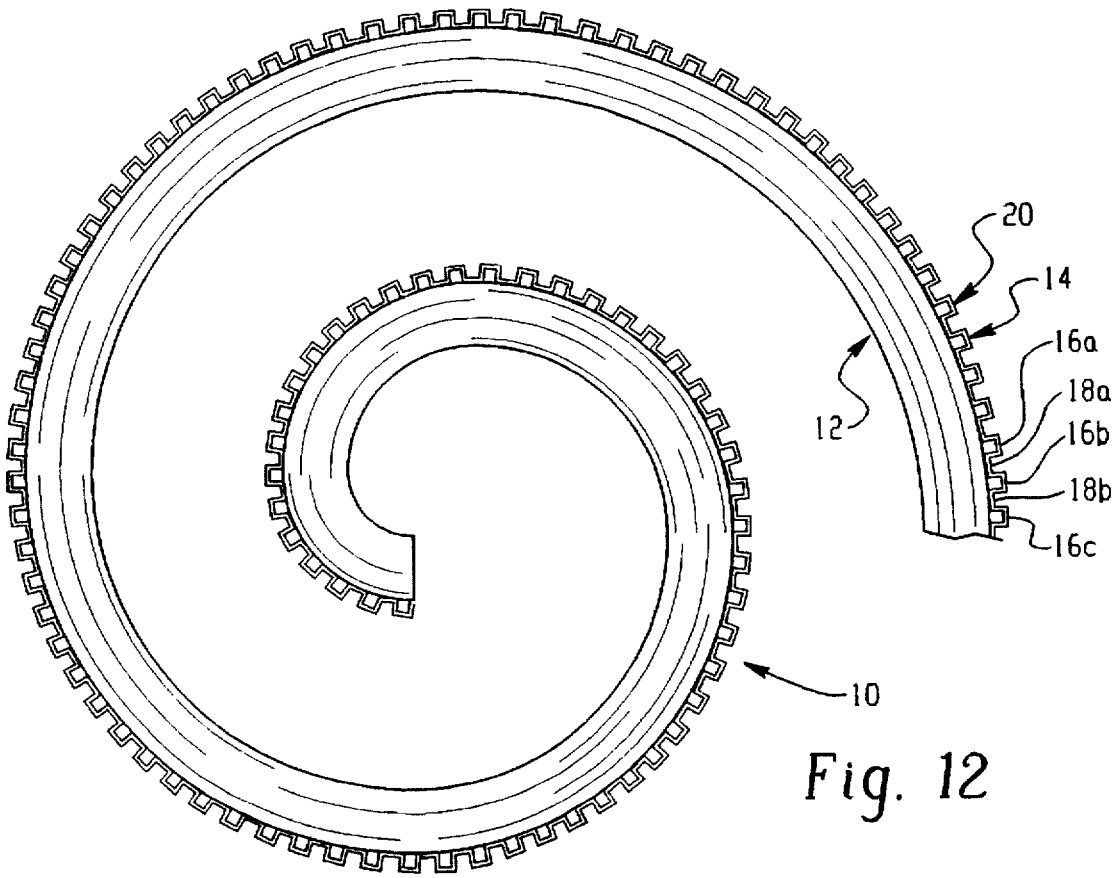
FIG. 12 is an end elevation illustrating an alternate form of the invention.

The device 10 includes a substrate 12 which may be made from plastic, glass, ceramic, coated metal, or other suitable material. The substrate 12 preferably is a dimensionally stable structure with an electrically insulating surface. While the substrate may be flat, it can also be of such other shape as may be convenient for the desired application, and may in fact be curved or, cylindrical; (FIG. 11) of may be comprised of a non-rigid material such that it may be formed into a desired shape, such as, for example, a spiral, (FIG. 12) after fabrication.

The substrate 12 supports a pressure generating element 14, which may be, for example, an exothermic element comprised of an electrically resistive thin film of metal or metal oxide. Suitable materials include, for example, indium tin oxide which is well known and commonly used to create conductor patterns on glass surfaces used in liquid crystal displays, and to fabricate thin film resistors. The element 14 may be applied to substrate 12 by, for example, a vapor deposition process as is well known. Alternatively, pressure generating element 14 may be a piezoelectric element comprised of a material having piezoelectric properties such as, for example, polyvinylidene fluoride (PVDF), marketed by AMP Incorporated under the Kynar® name, and attached to the substrate by adhesive bonding.

Figure 8:
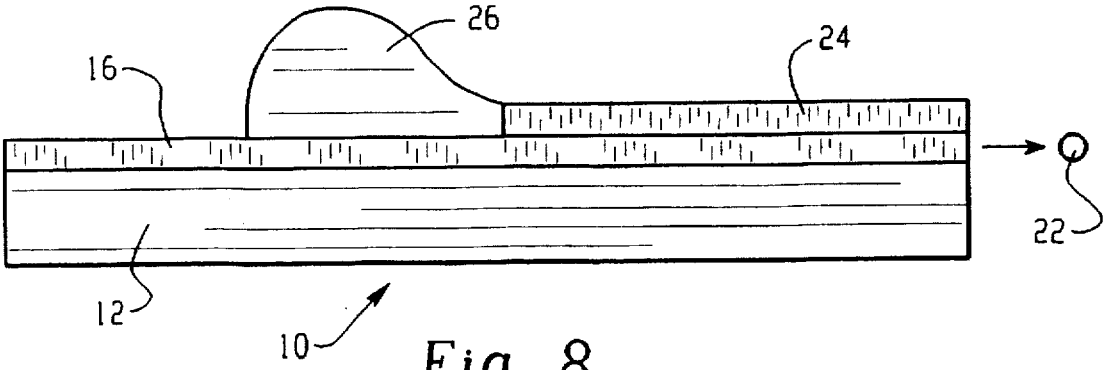
FIG. 8 is a side elevation illustrating an alternative embodiment of the device of FIG. 1.
Figure 9:
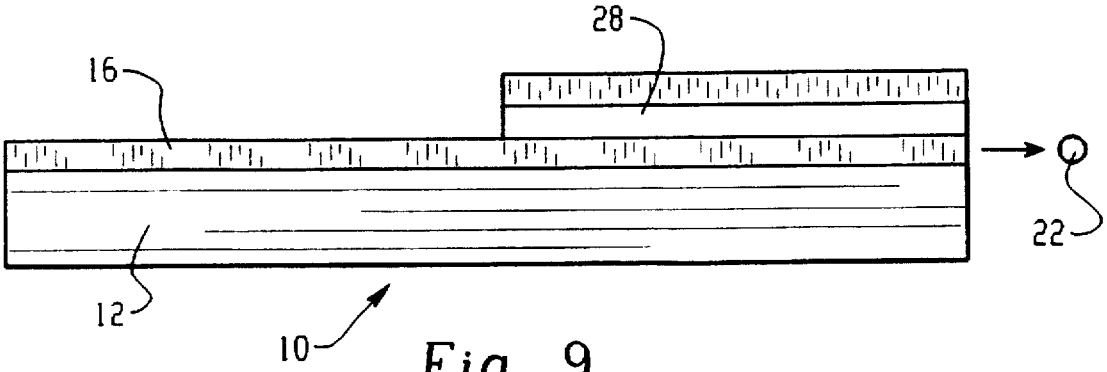
FIG. 9 is a side elevation illustrating an alternative embodiment of the device of FIG. 1.
Figure 10:
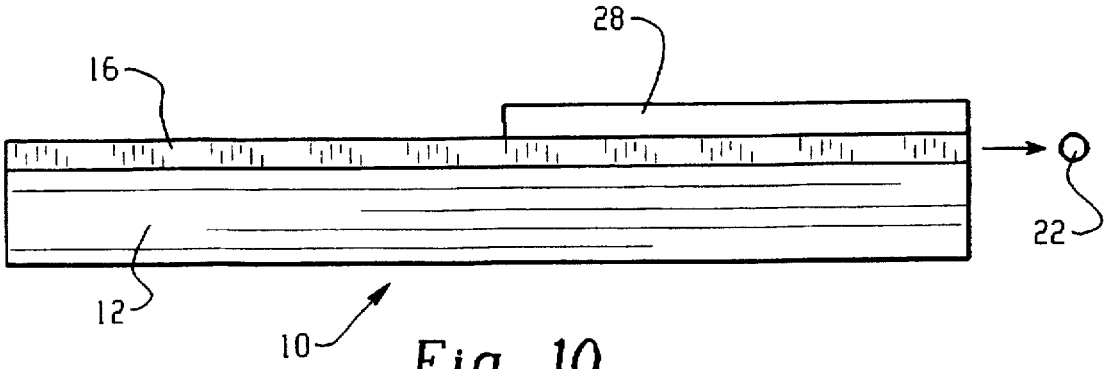
FIG. 10 is a side elevation illustrating an alternative embodiment of the device of FIG. 1.

The substrate 12 also has applied to it a number of conductors 16*a*, 16*b*, 16*c*, etc. These conductors serve not only to provide a means of electrical connection to the pressure generating element 14 at taps 20, but also as side walls for ink channels or capillaries 18*a*, 18*b*, 18*c*, etc. Conductors 16 may be comprised of copper, and fabricated upon the substrate using conventional printed circuit fabrication techniques as are well known. A cover 21 may be adhesively bonded to the conductors 16, or, alternatively, held in place by some clamping means (not shown), comprising the fourth and final side of the ink channels 18. Ink may be introduced into the ink channels from an ink supply bladder, 26 (FIG. 8) as in the prior art or, alternatively, an ink saturated pad 28 (FIG. 9). In one embodiment, said ink saturated pad not only serves as an ink supply, but is also used as a cover (FIG. 10). Capillary action fills the ink channels 18 with ink.

When an appropriate voltage pulse is applied across adjacent conductors, 16*a* & 16*b*, for example, that same pulse is applied across that portion of the pressure generating element 14 which lies between the conductors, and energizes that portion of the element. In the case of an exothermic pressure generating element, a heat pulse vaporizes ink, creating a bubble, which in turn causes a drop of ink 22 to be ejected from the end of the ink channel 18*a*. No separate nozzle structure is required: the end of the ink channel comprises the nozzle. Where a piezoelectric pressure generating element is used, the applied voltage pulse causes an increase in size of that portion of the element 14 across which it has been applied, resulting in a pressure pulse which in turn causes a drop of ink 22 to be ejected from the end of the ink channel.

Figure 3:
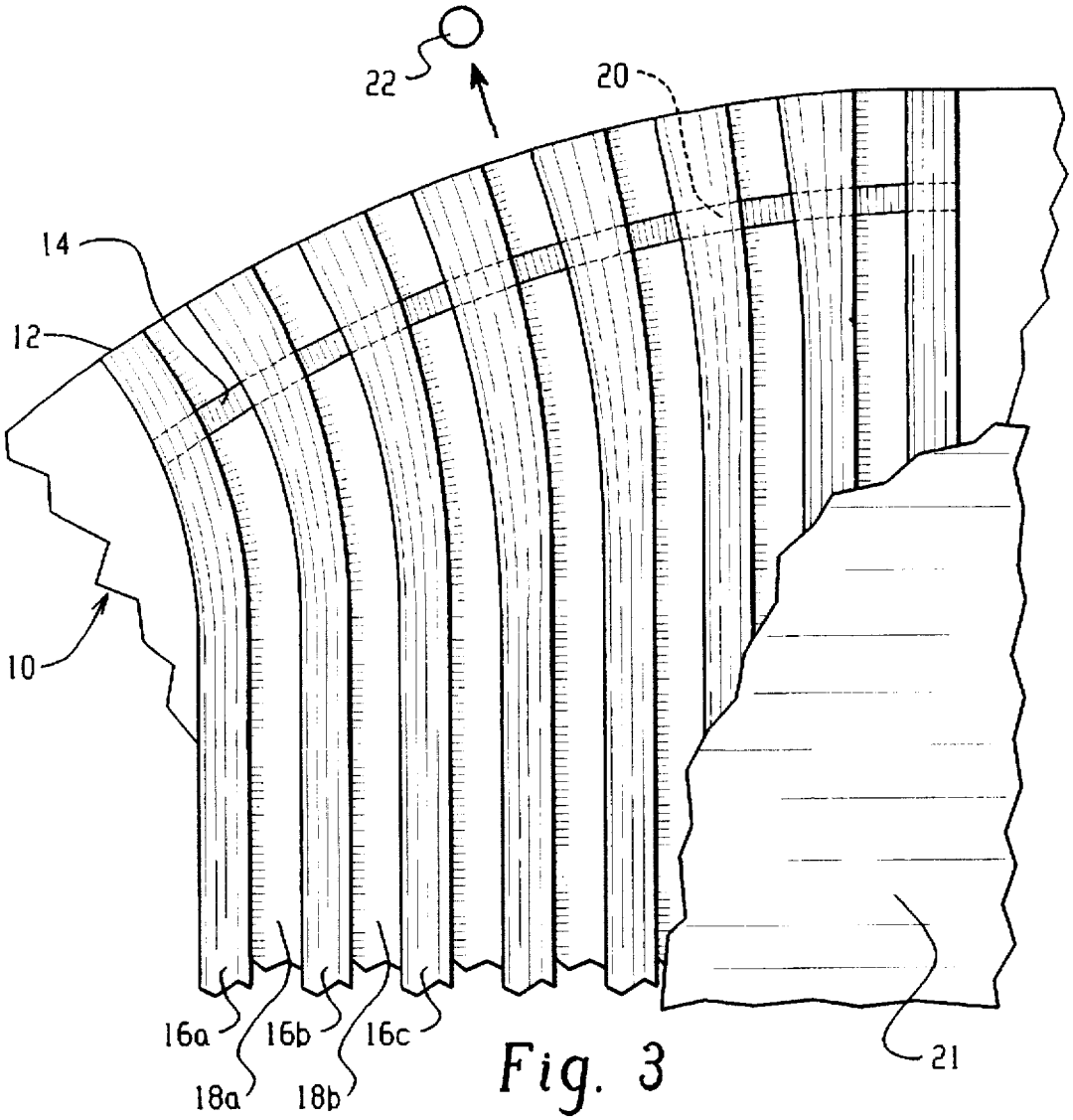
FIG. 3 alternative embodiment of the device of invention wherein the ink jet recording head has ink channels disposed at divergent angles.
Figure 13:
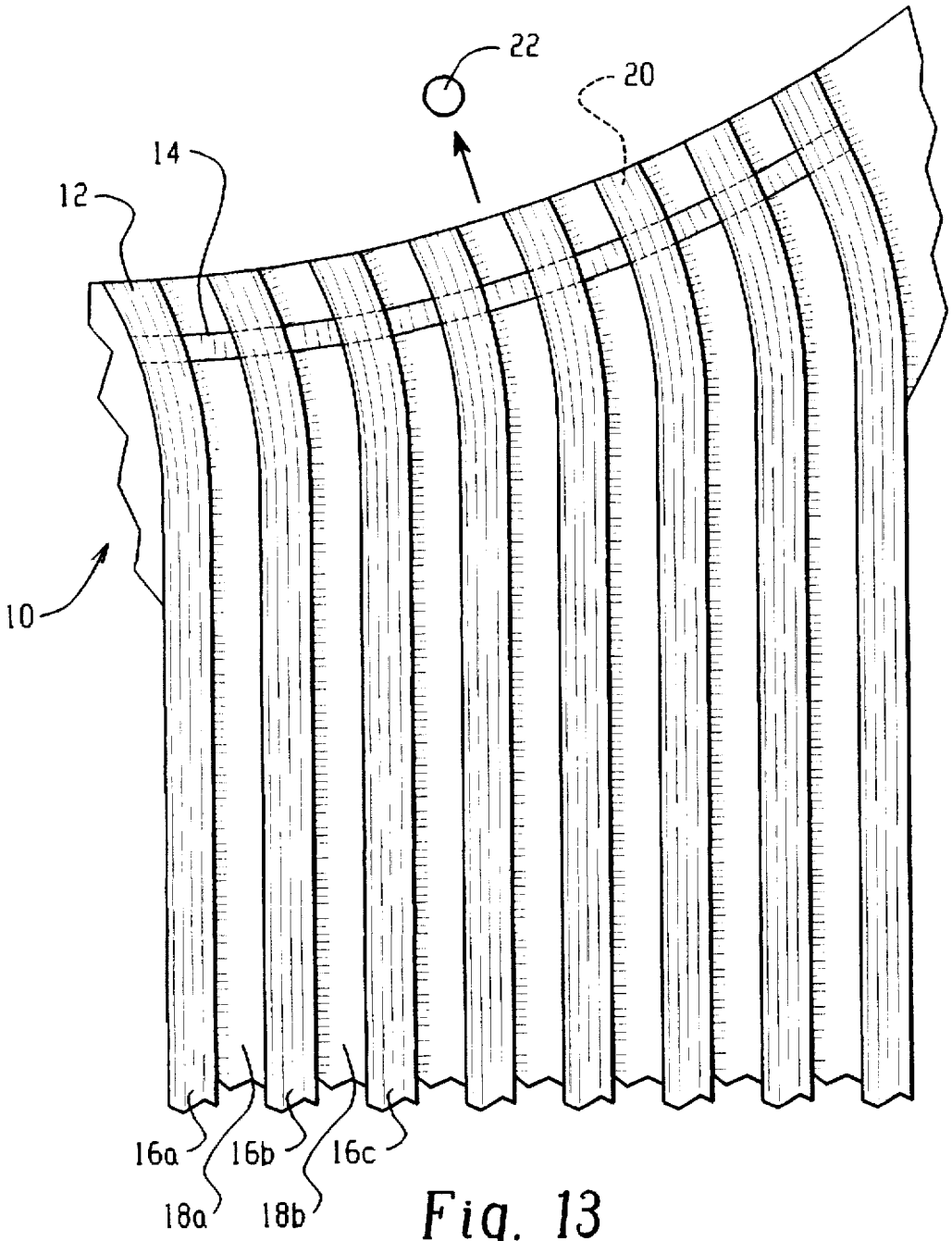
FIG. 13 illustrates an alternative embodiment of the device of FIG. 1 having ink channels disposed at convergent angles.

This structure has several advantages over the prior art. The pressure generating element 14 may be spaced some distance from the end of the ink channel as shown. This results in the ink drop being ejected from what is, effectively, a longer nozzle, like a rifle barrel, thus affording more control over the drop's trajectory. The drop will travel along a path which is an extension of the ink channel, and the angle between adjacent ink channels may, if desired, be made divergent (FIG. 3), so that ink drops are ejected from adjacent nozzles on divergent paths. A portion of such a recording head is shown in FIG. 3. Similarly, ink channels may be disposed at convergent angles, (FIG. 13) so that ink drops are projected on convergent paths.

Figure 4:
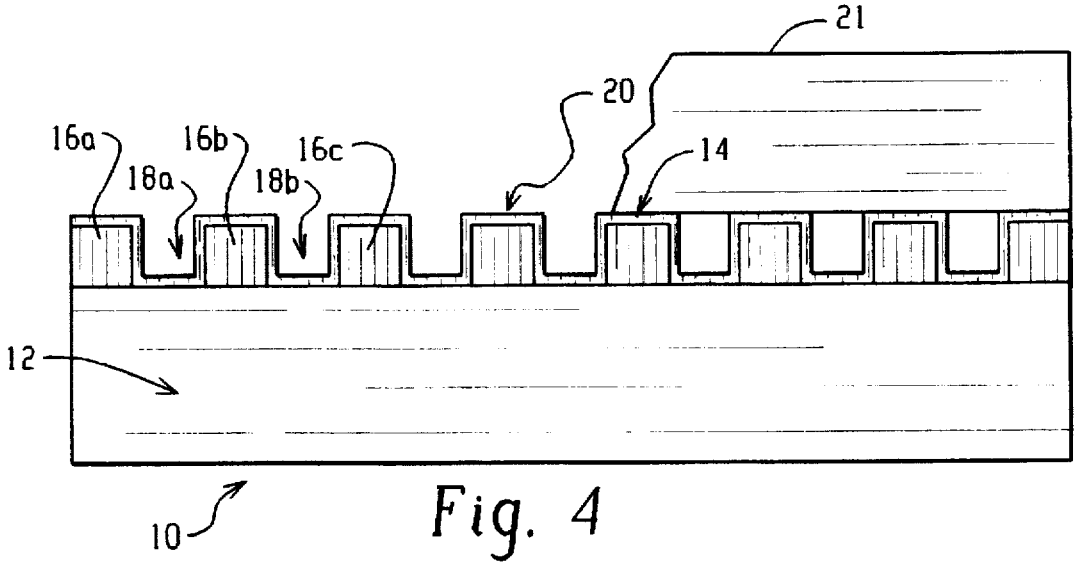
FIG. 4 illustrates alternative embodiment of the is an end elevation of another a pressure generating element which overlays the conductors.

While one sequence of fabrication has been described for illustrative purposes, it is recognized and understood that a number of means may be used to achieve the same results. It may, for instance, be desirable in some instances to fabricate the conductors upon the substrate prior to the application of the pressure generating element. Placement of the element 14 above, rather than below, the conductors 16 is illustrated in FIG. 4. It is also possible to place the pressure generating element on the cover. Electrical contact between the element and the conductors is achieved in this case by pressure applied by a clamping device, or by a conductive adhesive.

Because the recording head described is fabricated by deposition, plating, and etching processes on a single substrate, no precision assembly is required. The cover is uniform and its position on the head is not critical, except in the case where the pressure generating element 14 has been fabricated on the cover, and even here positioning is semi-critical in only one dimension. It is noteworthy that the processes used in the fabrication of the head are routinely used in the manufacture of printed circuit boards on a low cost, mass production basis. Recording heads made as herein described may be fabricated on large sheets of substrate material, comprising a large number of heads, which are then cut into individual units. While similar methods are used to produce the separate components of recording heads according to the prior art, subsequent precision assembly is required.

As has been described, the recording head is driven by a voltage pulse applied across two adjacent conductors, one on either side of the element portion to be energized, corresponding to the nozzle from which an ink drop is to be expelled. If it is desired that only one portion at a time be energized, then the drive circuitry can simply apply a pulse as described, while all other conductors are left open circuited.

It is noteworthy that in this recording head configuration one cannot simply hold all conductors "low" while driving only the selected line "high", because to do so would result in two element portions being energized, one on either side of the conductor driven high during the firing pulse. For example, referring to FIGS. 1 & 2, assume that conductor 16*b* is driven high, while all other conductors (including 16*a* & 16*c*) are low. Voltage will appear across the element 14 portions in both ink channels 18*a* & 18*b*, energizing both and causing an ink drop to be expelled from both corresponding nozzles. In order to energize only 18*a*, 16*a* should be held low, and 16*b* driven high (or vice versa), with 16*c* open circuited.

Alternatively, 16*a* could be driven high, 16*b* held low, and 16*c* (and all other conductors to the right of 16*c*) also held low. Or, 16*a* could be held low, and 16*b*, 16*c*, etc. all driven high. This serves to illustrate that with this recording head design, an element portion is energized only in response to a voltage difference. Any element portion with a high on one side, and a low on the other, will be energized.

Taking any desired print line, an appropriate drive signal can be derived by starting from one end, arbitrarily making the first conductor either high or low, then applying either the same or different voltage to the next conductor, depending upon whether the first element portion is to be energized or not. The third conductor voltage is made the same as, or different from, that of the second conductor, depending upon whether the second element portion should be energized, and so on, until all conductor voltages have been defined. An appropriate combination of conductors pulsed high and conductors held low (or vice versa) can be used to print any desired combination of dots.

According to the prior art, ink jet recording heads have typically required N+1 connections or electrodes, and N+1 drive sources or switching devices to drive N nozzles. Typically, each nozzle (corresponding to a pressure generating element portion) is addressed by one individual electrode, and by a single electrode common to all elements. One known method of reducing the required number of electrodes and drivers is to arrange the elements in groups, with each group having its own common electrode. The recording head of the present invention does not lend itself to a reduction in electrodes in this manner, because there are no common electrodes. As has been described, each nozzle is driven by a differential voltage applied across its corresponding element portion's adjacent conductors, and not by a signal applied with respect to some common reference.

It is, nonetheless, possible to reduce the number of electrodes and drivers required to drive the present recording head, as will be described. This technique results in a reduction of the number of required electrodes and drivers for a head of N nozzles from N+1 to $2\times N^{1/2}$. If, for example, a head has 100 nozzles, just 20 connections and drivers will be required, rather than 101. Where $N^{1/2}$ is not an integer, it must be rounded up to the next integral number.

Figure 5:
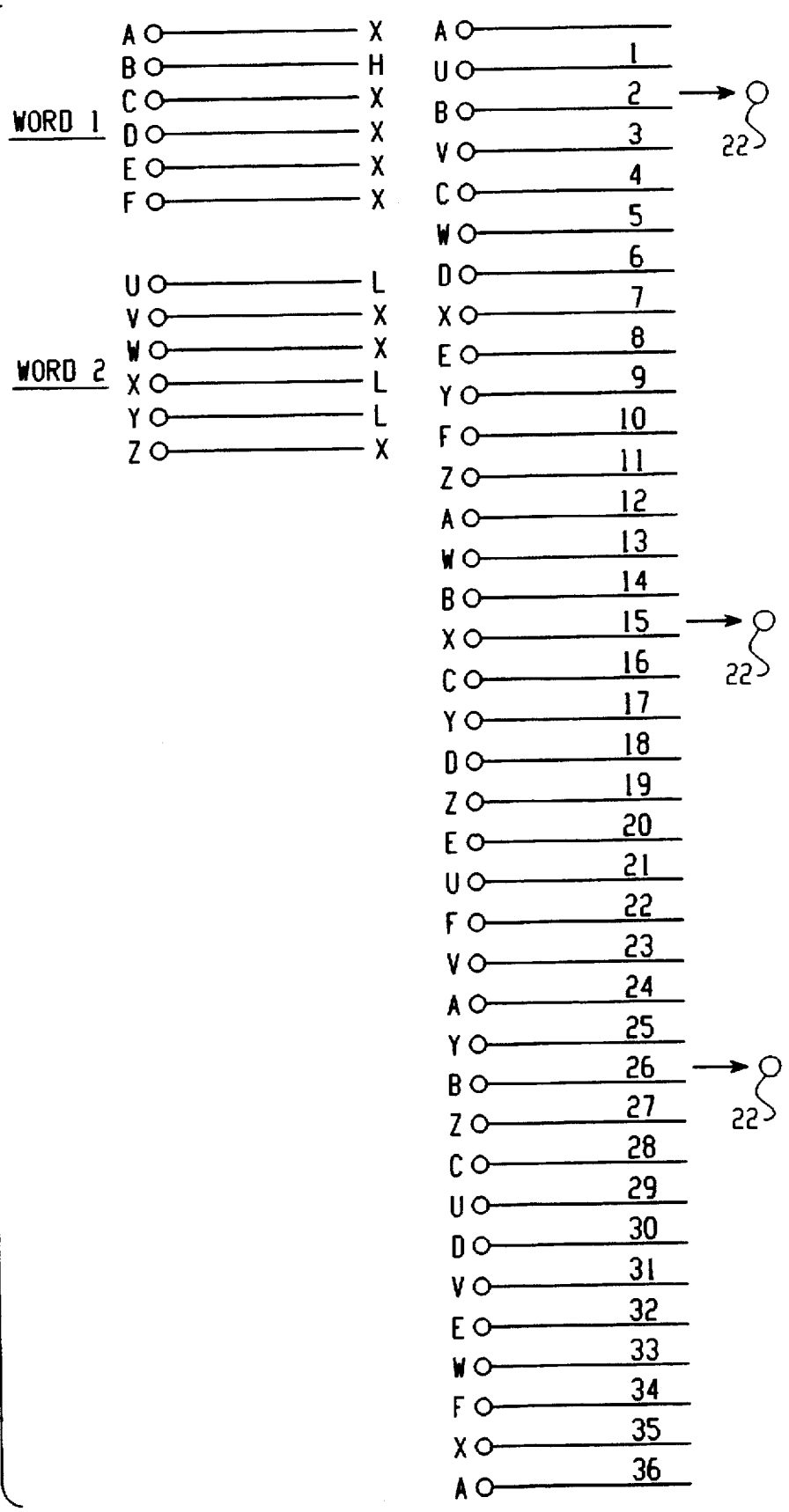
FIG. 5 is an electrical schematic illustrating a method for reducing the number of electrodes and drive sources required.
Figure 6:
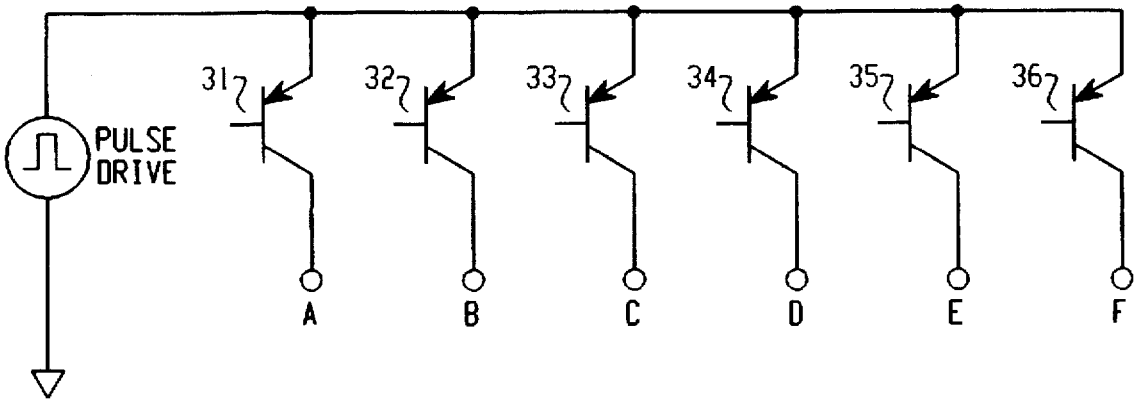
FIG. 6 illustrates an arrangement of drive switches and a driving pulse source applied as a first digital word.
Figure 7:
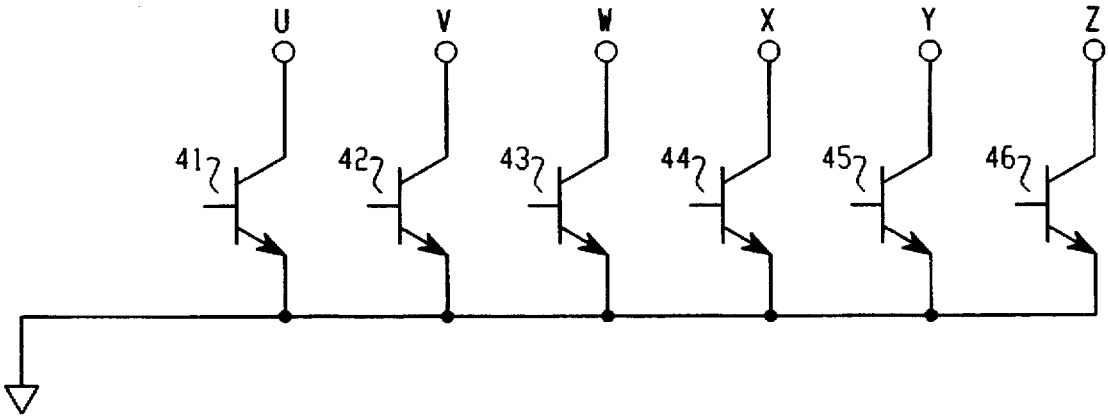
FIG. 7 illustrates an arrangement of drive switches and a circuit common applied as a second digital word.

The head 10 is driven by two digital words, each having $N^{1/2}$ bits. Referring to FIG. 5, for purposes of example a head of N=36 nozzles is shown, with Word 1 having $N^{1/2}$ (i.e. 6) bits identified as A–F, while Word 2 has 6 bits identified as U-Z. For one word, e.g. Word 1, each bit is binary, but the two binary states are not high and low, but rather high (connected to a pulse source) and open. This is readily implemented using a single switching device per bit, connected to a driving pulse source (FIG. 6). The other word, Word 2, is similarly comprised of binary bits where the two states are low (connected to a circuit common or ground) or open (FIG. 7). While the switching devices 31–36, 41–46 shown in FIGS. 6 & 7 are bipolar transistors, it will be readily appreciated that other devices such as, for example, field effect transistors, may be used as well. It may likewise be readily understood and appreciated that while a positive drive pulse is used for purposes of illustration, a negative drive pulse and switching devices of the appropriate polarity may be similarly used.

Words 1 & 2 are connected to the N (i.e. 36) nozzles of the recording head in an interleaved fashion as shown, for the first $2\times N^{1/2}$ (i.e. 12) connections. For the next $2\times N^{1/2}$ connections, the words are again interleaved, but Word 2 is advanced two positions, i.e. a sequence of W, X, Y, Z, U, V in this example. Similarly, the following $2\times N^{1/2}$ connections are again interleaved, with a further advance of Word 2 to Y, Z, U, V, W, X. Each nozzle is addressed by (driven by) its adjacent conductors. Nozzle 15, for example, is addressed by conductors B & X, and will be fired only when B is high and X is low, or vice versa. The advance of one word with respect to the other by two positions provides a unique address for every nozzle. Word 1 will have just one bit high at a time, while the other bits are open. Word 2 may have any number of low bits at once, as is appropriate for the pattern to be printed. For example, in FIG. 5, Word 1 has bit B high (indicated by "H"), and all other bits open (indicated by "X"). Word 2 has U, X, & Y held low (indicated by "L"), and V, W, & Z open ("X"). Only those nozzles defined by conductors B & U, B & X, and B & Y will fire, as shown. Alternatively, Word 2 may have just one bit low at a time, while the other bits are open, while Word 1 has any number of bits high at once, as is appropriate for the pattern to be printed. As a further alternative, Word 1 may have just one bit high, and Word 2 may have just one bit low, so that just one nozzle is fired at any one time.

In the manner described a total of just $2\times N^{1/2}$ electrodes and drive switches are 31–36, 41–46 electrodes, and the N conductors, can be made according to FIG. 5 by, for example, conventional printed circuit techniques as are well known. Substrate 12 may, for example, be comprised of a multilayer printed circuit board for this purpose.

A further consideration, where the pressure generating element 14 is an exothermic thin film, is to provide means to regulate the temperature of the element. In apparatus according to the prior art, variations in the amount of energy applied to an exothermic pressure generating element cause deviations in ink drop trajectories. Energy variations may be due, for example, to differences in resistance from one element portion to another, changes in resistance of a given element portion due to temperature, aging, or other factors, changes in driving source voltage or impedance, deviations in driving source pulse width, or other factors. In addition, element portion temperature will vary as a function of ambient temperature and time elapsed since the last energization of the element portion. According to the prior art, operation of the recording head at too high a frequency (i.e. too little elapsed time between energizations) can result in permanent damage to the head.

Figure 14:
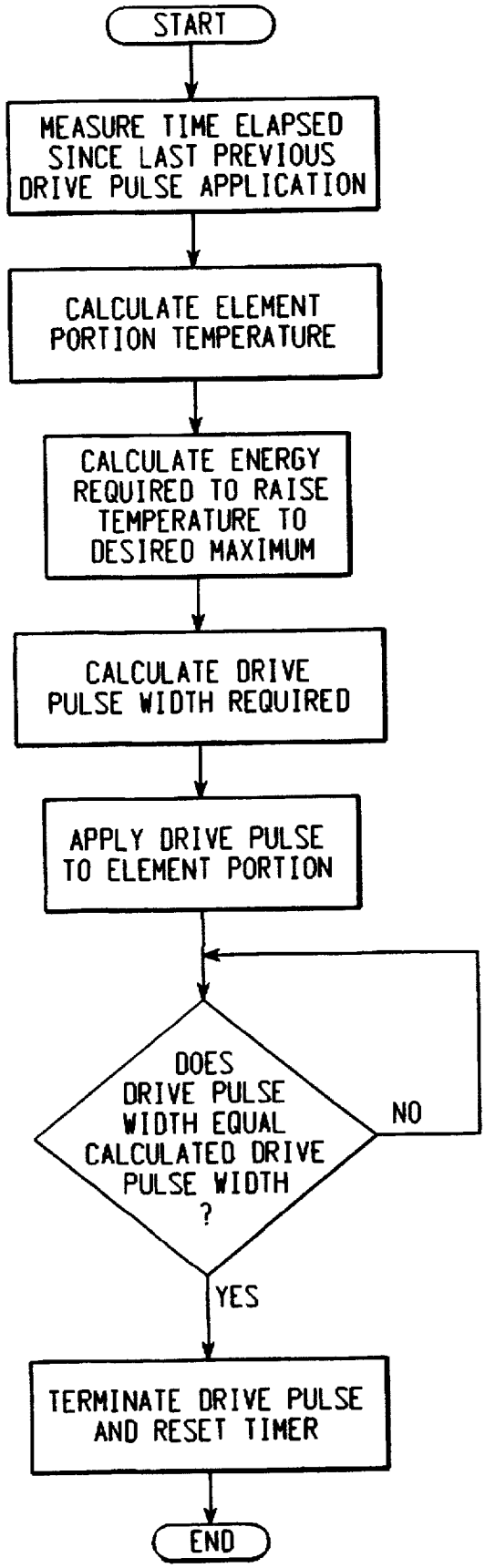
FIG. 14 is a flow chart illustrating a process for driving an exothermic pressure generating element in accordance with a method of the invention.

One method of protecting the individual element portions from damage due to too high an operating frequency is to adjust the drive source energy in response to operating frequency, based upon the thermal time constant of the element portion. If the elapsed time since the last energization of a particular element portion exceeds some time t, the temperature of the element portion is assumed to be at ambient, and a drive pulse of some energy calculated to raise the element portion to proper operating temperature is applied. If the elapsed time is somewhat less than t, the element portion is assumed to have not cooled to ambient, and a drive pulse of somewhat reduced energy is applied. If the elapsed time is much less than t, the element portion is assumed to have cooled very little, and a drive pulse of greatly reduced energy will be applied. This method requires a means of determining the interval between drive pulses for each element portion and using that time interval to calculate how much energy should be applied with the next drive pulse. This may be accomplished using a microprocessor or other control device using a suitable algorithm. In addition, some means of adjusting drive pulse energy is necessary. This may be accomplished readily by, for example, adjusting the width (duration) of the drive pulse (FIG. 14).

Figure 15:
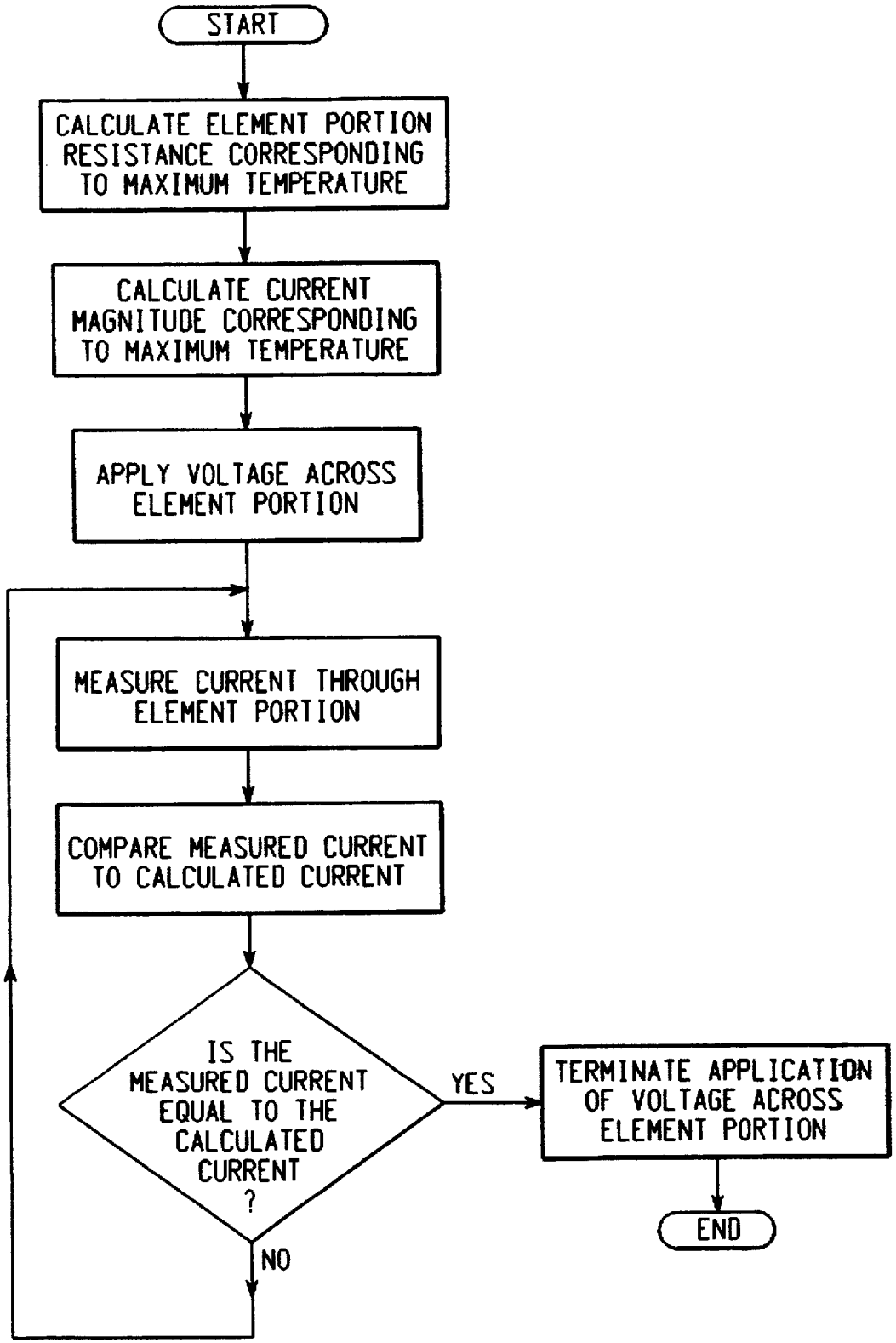
FIG. 15 is a flow chart illustrating a process for driving an exothermic pressure generating element in accordance with another method of the invention.

By actually monitoring the temperature of each individual element portion during a drive pulse, it is possible to both protect the element from damage due to overheating, and regulate the temperature of each element portion, thus achieving superior control of ink drop trajectory. If the material comprising the exothermic pressure generating element 14 has a temperature coefficient of resistance which is non-zero in the region of the desired operating temperature, as is typical of most materials, then the resistance of the element portion at the desired temperature may be calculated. If a drive pulse of known voltage is applied to the element portion, then the unique current magnitude which will flow through the element portion only at the desired temperature can also be determined. By sensing the actual element portion current and comparing its magnitude to that expected at the desired temperature, the drive pulse can be terminated as soon as that desired temperature is reached. In this manner the width of the drive pulse is determined by the actual temperature of the element portion. The element portion current may be readily sensed by using a sensing resistor and comparator as are well known (FIG. 15).

Figure 16:
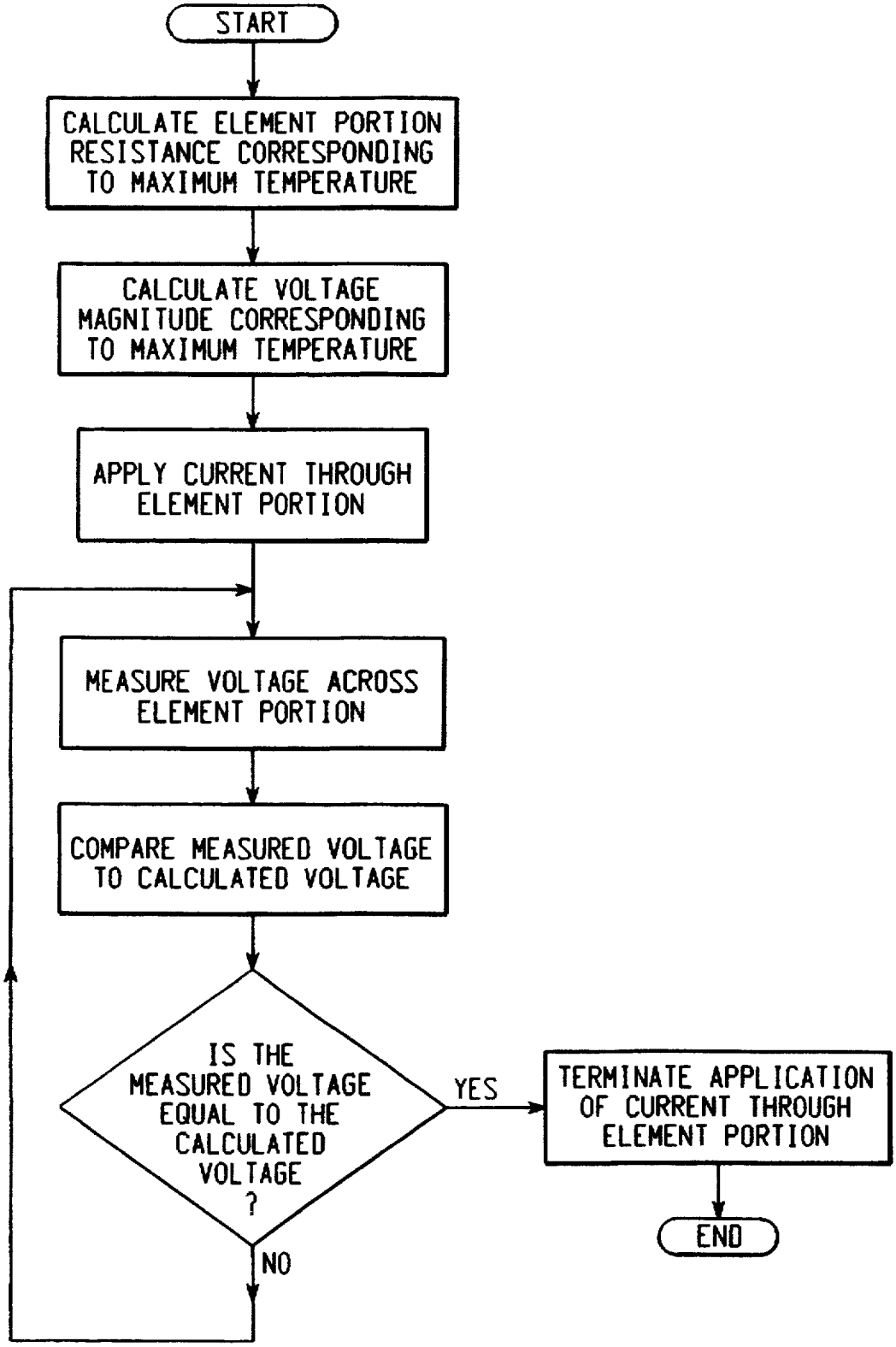
FIG. 16 is a flow chart illustrating a process for driving an exothermic pressure generating element in accordance with another method of the invention.

Alternatively, a drive pulse of known current may be applied, and a voltage corresponding to the desired element portion temperature may be calculated. In similar fashion to that described, the actual voltage may be monitored and compared with that corresponding to the desired temperature, with the drive pulse being terminated responsive to said desired temperature being reached (FIG. 16).

In another aspect of the present invention, the pressure generating element 14 may, be an exothermic element comprised of a material having a positive and non-linear temperature coefficient of resistance such that element portion temperature is inherently regulated. The required characteristics of this material must be such that an initial application of voltage will result in energy flow into the element portion such that temperature will rise at a desired rate, but as the desired temperature is approached, the resistance of the element portion must increase such that no further temperature rise will occur. The width of the drive voltage pulse may be fixed at any convenient duration which equals or exceeds the maximum needed to achieve the desired temperature. In this manner the temperature of each element portion is inherently regulated. Suitable pressure generating element materials include polycrystalline ceramics as are well known and used in the fabrication of positive temperature coefficient (PTC) thermistors.

In still another aspect of the present invention, the pressure generating element 14 and conductors 16 may be protected from corrosion, and the ink protected from electrolytic action, by the application of a dielectric thin film of $SiO_2$, $Ta_2O_5$, glass or the like to prevent electrical contact between the ink and electrically energized portions of the head.

While the invention has been shown and described with respect to specific embodiments thereof, this is for the purpose of illustration rather than limitation, and other variations and modifications of the specific embodiments herein shown and described will be apparent to those skilled in the art within the intended spirit and scope of the invention as set forth in the appended claims. Accordingly, the patent is not to be limited in scope and effect to the specific embodiments herein shown and described nor in any other way that is inconsistent with the extent to which the progress in the art has been advanced by the invention.

I claim:

1. In an ink jet recording head including an ink reservoir, electrical elements for selectively generating discrete fluid pressure pulses to cause ink to be ejected in predetermined patterns and a plurality of taps operatively connected to said electrical elements, the improvement comprising:

a dielectric substrate having a top face, a dielectric cover spaced above said top face, a plurality of electrical conductors disposed between said substrate and said cover, and having side faces contiguous with said substrate and said cover, each of said conductors being operatively connected to one of said taps, and a plurality of ink flow channels, located between said substrate and said cover and having side walls defined by the respective side faces of adjacent conductors, said electrical elements being operatively associated with said flow channels, said flow channels communicating with said ink reservoir, and one end of each respective flow channel being open to define an ink ejection nozzle.

2. The apparatus of claim 1 wherein said electrical elements are exothermic elements.

3. The apparatus of claim 2 wherein said exothermic elements have a non-zero temperature coefficient of resistance.

4. The apparatus of claim 3 wherein said temperature coefficient of resistance is positive and non-linear over a temperature range including a maximum desired operating temperature.

5. The apparatus of claim 1 wherein said electrical elements are piezoelectric elements.

6. The apparatus of claim 1 wherein said ink reservoir comprises a bladder.

7. The apparatus of claim 1 wherein said ink reservoir comprises an ink saturated pad.

8. The apparatus of claim 1 wherein said cover comprises an ink-saturated pad.

9. The apparatus of claim 1 wherein said substrate is flat.

10. The apparatus of claim 1 wherein said substrate is curved.

11. The apparatus of claim 1 wherein said substrate is cylindrical.

12. The apparatus of claim 1 wherein said substrate is formed into a spiral.

13. The apparatus of claim 1 wherein said ink flow channels are disposed parallel to each other.

14. The apparatus of claim 1 wherein said ink flow channels are disposed at divergent angles to each other.

15. The apparatus of claim 1 wherein said ink flow channels are disposed at convergent angles to each other.

16. The apparatus of claim 1 wherein said ink flow channels are dielectrically insulated.

17. The apparatus of claim 1 wherein said plurality of taps are N+1 in number and said electrical elements are N in number and wherein a first tap group, comprising every alternate one of said taps, is electrically connected via a first group of said conductors to a first set of electrodes, $N^{1/2}$ in number, and a second tap group, comprising all taps not included in said first tap group, is electrically connected by a second group of said conductors to a second set of electrodes, also $N^{1/2}$ in number.

* * * * *